US010889964B2

(12) United States Patent
Shimizu et al.

(10) Patent No.: US 10,889,964 B2
(45) Date of Patent: Jan. 12, 2021

(54) DRIVE SYSTEM FOR CONSTRUCTION MACHINE

(71) Applicant: Hitachi Construction Machinery Co., Ltd., Tokyo (JP)

(72) Inventors: Juri Shimizu, Hitachinaka (JP); Kenji Hiraku, Kasumigaura (JP); Hiromasa Takahashi, Abiko (JP); Shohei Sugiki, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/493,413

(22) PCT Filed: Apr. 6, 2018

(86) PCT No.: PCT/JP2018/014782
§ 371 (c)(1),
(2) Date: Sep. 12, 2019

(87) PCT Pub. No.: WO2019/053933
PCT Pub. Date: Mar. 21, 2019

(65) Prior Publication Data

US 2020/0131736 A1 Apr. 30, 2020

(30) Foreign Application Priority Data

Sep. 14, 2017 (JP) ..... 2017-177202

(51) Int. Cl.
*E02F 9/22* (2006.01)
*E02F 3/40* (2006.01)
(Continued)

(52) U.S. Cl.
CPC ..... *E02F 9/2267* (2013.01); *E02F 3/40* (2013.01); *F15B 9/04* (2013.01); *F15B 15/02* (2013.01)

(58) Field of Classification Search
CPC ..... E02F 9/2232; E02F 9/2235; E02F 9/2239; E02F 9/2242
See application file for complete search history.

(56) References Cited

U.S. PATENT DOCUMENTS 4,369,625 A * 1/1983 Izumi ..... E02F 9/2292 414/699
2012/0260641 A1* 10/2012 Opdenbosch ..... E02F 9/2217 60/327

(Continued)

FOREIGN PATENT DOCUMENTS

JP 59-99102 A 6/1984
JP 62-88805 A 4/1987

OTHER PUBLICATIONS

International Preliminary Report on Patentability (PCT/IB/338 & PCT/IB/373) issued in PCT Application No. PCT/JP2018/014782 dated Mar. 26, 2020, including English translation of document C2 (Japanese-language Written Opinion (PCT/ISA/237) previously filed on Sep. 12, 2019 (seven pages).

(Continued)

*Primary Examiner* — Michael Leslie
*Assistant Examiner* — Matthew Wiblin
(74) *Attorney, Agent, or Firm* — Crowell & Moring LLP

(57) ABSTRACT

Provided is a work machine that can selectively establish a closed circuit connection between a single rod-type hydraulic cylinder and a plurality of bidirectional-type hydraulic pumps, the work machine being capable of enhancing responsiveness of the single rod-type hydraulic cylinder when a high-speed lever switching operation is conducted in a state in which a rod pressure of the single rod-type hydraulic cylinder is higher than a bottom pressure. When a bucket lever (70*a*) is operated to a side of extending the bucket cylinder in a state in which a pressure in a rod chamber (5*b*) of the bucket cylinder (5) is higher than a (Continued)

pressure in a bottom chamber (5*a*), a controller (50) opens a rod-side proportional valve (45) and discharges a working fluid in the rod chamber to a working fluid tank (25) such that a differential pressure between the pressure in the rod chamber and the pressure in the bottom chamber is reduced below a switching pressure (Psw) of a flushing valve (33).

4 Claims, 7 Drawing Sheets

(51) Int. Cl.
*F15B 9/04* (2006.01)
*F15B 15/02* (2006.01)

(56) References Cited

U.S. PATENT DOCUMENTS

2013/0098012 A1* 4/2013 Opdenbosch ..... E02F 9/2296 60/327
2013/0098024 A1* 4/2013 Knussman ..... E02F 9/2289 60/420
2013/0098459 A1* 4/2013 Opdenbosch ..... F17D 3/00 137/2
2013/0312399 A1* 11/2013 Hiraku ..... E02F 9/2217 60/422
2014/0033689 A1* 2/2014 Opdenbosch ..... F15B 7/006 60/325
2014/0165549 A1* 6/2014 Gabibulayev ..... E02F 9/2289 60/421
2014/0283508 A1* 9/2014 Hiraku ..... E02F 9/2292 60/328
2015/0292526 A1* 10/2015 Saitoh ..... E02F 9/2285 60/477
2016/0177539 A1* 6/2016 Hiraku ..... F15B 11/17 60/428
2018/0251960 A1* 9/2018 Takahashi ..... E02F 9/2296

OTHER PUBLICATIONS

International Search Report (PCT/ISA/210) issued in PCT Application No. PCT/JP2018/014782 dated Jun. 26, 2018 with English translation (six pages).
Japanese-language Written Opinion (PCT/ISA/237) issued in PCT Application No. PCT/JP2018/014782 dated Jun. 26, 2018 (four pages).

* cited by examiner (PRESENT INVENTION)

DRIVE SYSTEM FOR CONSTRUCTION MACHINE

TECHNICAL FIELD

The present invention relates to a drive system for a construction machine including a hydraulic circuit for driving a hydraulic actuator directly by a hydraulic pump.

BACKGROUND ART

In recent years, in a work machine such as a hydraulic excavator, development has been under way of a hydraulic circuit (closed circuit) having a configuration in which for reducing the number of restrictors in a hydraulic circuit for driving hydraulic actuators such as hydraulic cylinders and for reducing fuel consumption rate, a working fluid from a hydraulic drive source such as a hydraulic pump is sent to the hydraulic actuator, and the working fluid having used for work at the hydraulic actuator is not returned to a tank but is returned to the hydraulic pump. The prior art of such a closed circuit is disclosed, for example, in Patent Document 1.

Patent Document 1 describes an actuator drive circuit that includes a closed circuit having an actuator (a single rod-type hydraulic cylinder), a plurality of hydraulic pumps (hydraulic pumps) for driving the actuator, and selector valves interposed between the hydraulic pumps and the actuator, and that includes operating means for operating the selector valves, in which the actuator can be driven by joining of the hydraulic fluids delivered from the plurality of hydraulic pumps. In the actuator drive circuit, a switching device for outputting a signal is provided in connection with the operating means, and the operating means operates the selector valves according to a signal from the switching device in such a manner that a circuit linking a delivery port of one of the plurality of hydraulic pumps and one port of the actuator and a circuit linking a delivery port of another one of the plurality of hydraulic pumps and another port of the actuator are alternately brought into communication and interruption of the communication.

In addition, the actuator drive circuit described in Patent Document 1 includes a flushing valve (low pressure selection valve) which is provided between a bottom-side line connected to the bottom chamber of the single rod-type hydraulic cylinder and a rod-side line connected to the rod chamber of the single rod-type hydraulic cylinder, and by which a surplus flow rate on a lower-pressure side one of the bottom-side line and the rod-side line is discharged to a working fluid tank.

PRIOR ART DOCUMENT

Patent Document

Patent Document 1: JP-Sho-59-99102-A

SUMMARY OF THE INVENTION

Problems to be Solved by the Invention

In a hydraulic excavator, for dropping mud and the like adhering to the bucket, an operation of shaking the bucket up and down (bucket mud dropping operation) is conducted in a state in which the arm is held vertical and the bucket cylinder is contracted to the vicinity of a stroke end (a state in which the center of gravity of the bucket is located on the bucket cylinder side as compared to a linking portion between the arm and the bucket). In this instance, for extending and contracting the bucket cylinder at high speed, the operator performs an operation of switching the bucket lever between the side of extending the bucket cylinder and the side of contracting the bucket cylinder, at high speed (high-speed lever switching operation).

Here, in the case where the actuator drive circuit described in Patent Document 1 is applied to a bucket cylinder, the following problem would be generated.

In a state in which the arm is held vertical and the bucket cylinder is contracted to the vicinity of the stroke end, the rod pressure of the bucket cylinder is higher than the bottom pressure, and, therefore, a rod-side line on a lower pressure side is connected to the tank through a flushing valve.

When the bucket lever is switched from a side of extending the bucket cylinder to a side of contracting the bucket cylinder, all the delivery flow rate of the hydraulic pump flows into the rod chamber through a rod-side line on a higher pressure side, whereby the pressure in the rod chamber is swiftly raised. As a result, a force for driving the bucket cylinder to the contracting side swiftly overcomes the frictional resistance of the bucket cylinder and the like, and, therefore, the cylinder stroke is reduced according to the lever operation amount on the side of contracting the bucket cylinder even at the time of high-speed lever switching operation.

On the other hand, when the bucket lever is switched from the side of contracting the bucket cylinder to the side of extending the bucket cylinder, the working fluid is supplied from the hydraulic pump into the bottom chamber through a bottom-side line, but, since a bottom-side line on a lower pressure side is connected to the working fluid tank, the pressure in the bottom chamber cannot be raised, so that a force for driving the bucket cylinder to the extending side cannot swiftly overcome the frictional resistance of the bucket cylinder and the like. For this reason, at the time of high-speed lever switching operation, the cylinder stroke is little increased in response to the lever operation on the side of extending the bucket cylinder, such that responsiveness of the single rod-type hydraulic cylinder is lowered.

The present invention has been made in consideration of the above-mentioned problem. It is an object of the present invention to provide a work machine which can selectively establish closed circuit connection between a single rod-type hydraulic cylinder and a plurality of bidirectional-type hydraulic pumps, the work machine being capable of enhancing responsiveness of the single rod-type hydraulic cylinder when a high-speed lever switching operation is performed in a state in which the rod pressure of the single rod-type hydraulic cylinder is higher than the bottom pressure.

Means for Solving the Problems

In order to achieve the above object, according to the present invention, there is provided a work machine including: a work device including a plurality of work members; a single rod-type hydraulic cylinder that drives one of the plurality of work members; a bottom-side line connected to a bottom chamber of the single rod-type hydraulic cylinder; a rod-side line connected to a rod chamber of the single rod-type hydraulic cylinder; a bidirectional-type first hydraulic pump of which a delivery port on one side is connected to the bottom-side line through a first control valve and a delivery port on an other side is connected to the rod-side line through the first control valve; a bidirectional-type second hydraulic pump of which a delivery port on one side is connected to the bottom-side line through a second control valve and a delivery port on an other side is connected to the rod-side line through the second control valve; an operation lever device having an operation lever for operating the single rod-type hydraulic cylinder to extend and contract; a working fluid tank; a flushing valve that is connected to the rod-side line and the rod-side line, and that discharges a surplus flow rate of a lower-pressure side one of the bottom-side line and the rod-side line into the working fluid tank when a differential pressure between the bottom-side line and the rod-side line exceeds a predetermined pressure; and a controller that controls opening/closing of the first and second control valves and controls tilting amounts of the first and second hydraulic pumps, in which the work machine further includes a bottom pressure sensor that detects a pressure in the bottom chamber; a rod pressure sensor that detects a pressure in the rod chamber; a rod-side discharge line that connects the rod-side line and the working fluid tank; and a rod-side proportional valve provided in the rod-side discharge line, and when the operation lever is operated to a side of extending the single rod-type hydraulic cylinder in a state in which the pressure in the rod chamber is higher than the pressure in the bottom chamber, the controller opens the rod-side proportional valve to discharge a working fluid in the rod chamber into the working fluid tank such that a differential pressure between the pressure in the rod chamber and the pressure in the bottom chamber is reduced below the predetermined pressure.

According to the present invention configured as above, when the operation lever is switched from the side of contracting the single rod-type hydraulic cylinder to the side of extending the single rod-type hydraulic cylinder in a state in which the rod pressure of the single rod-type hydraulic cylinder is higher than the bottom pressure, the rod-side proportional valve is opened and part of the working fluid in the rod chamber is discharged into the working fluid tank, such that the rod pressure is swiftly lowered. Then, with the differential pressure between the bottom pressure and the rod pressure reduced below the switching pressure of the flushing valve, the flushing valve is returned into a neutral position, and the communication between the bottom-side line and the working fluid tank is interrupted. As a result, all the delivery flow rate of the first or second hydraulic pump flows into the bottom chamber, the bottom pressure is swiftly raised, and the force for driving the single rod-type hydraulic cylinder to the extending side swiftly overcomes the frictional resistance of the single rod-type hydraulic cylinder and the like. Accordingly, when a high-speed lever switching operation is performed, the cylinder stroke is increased according to the lever operation amount on the side of extending the single rod-type hydraulic cylinder, and, therefore, responsiveness of the single rod-type hydraulic cylinder can be enhanced.

Advantage of the Invention

According to the present invention, in a work machine capable of selectively establishing closed circuit connection between a single rod-type hydraulic cylinder and a plurality of bidirectional-type hydraulic pumps, it is possible to enhance responsiveness of the single rod-type hydraulic cylinder when a high-speed lever switching operation is performed in a state in which the rod pressure of the single rod-type hydraulic cylinder is higher than the bottom pressure.

MODES FOR CARRYING OUT THE INVENTION

Figure 1:
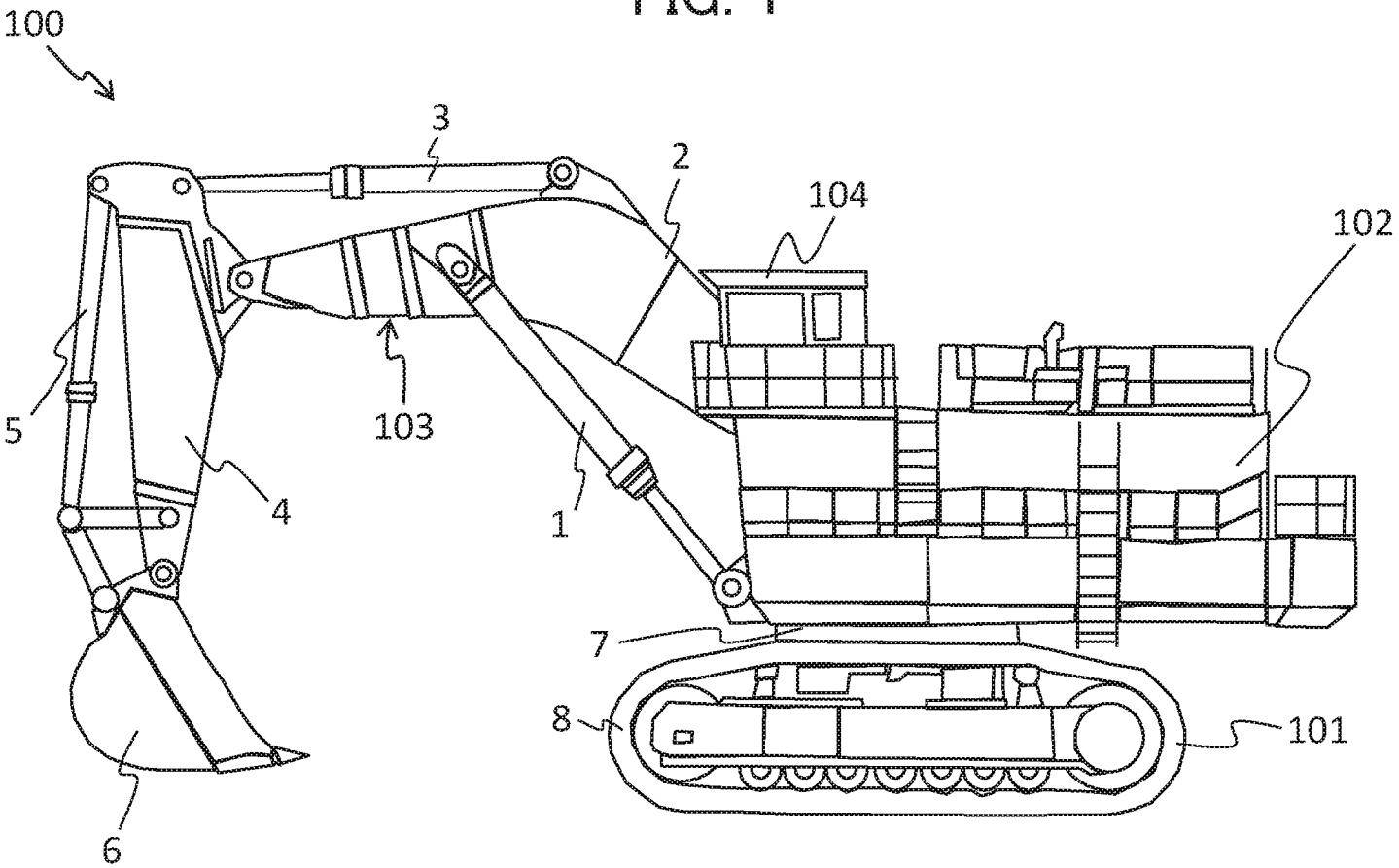
FIG. 1 is a side view of a hydraulic excavator according to an embodiment of the present invention.

A hydraulic excavator, taken as an example of a hydraulic work machine according to an embodiment of the present invention, will be described below referring to the drawings. Note that in the drawings the same or equivalent members are denoted by the same reference characters, and repeated descriptions of them will be omitted.

FIG. 1 is a side view of a hydraulic excavator according to an embodiment of the present invention.

In FIG. 1, the hydraulic excavator 100 includes a lower track structure 101 equipped with a crawler type track device 8, an upper swing structure 102 mounted onto the lower track structure 101 in a swingable manner through a swing device 7, and a front work device 103 mounted to a front portion of the upper swing structure 102 in a vertically rotatable manner. A cab 104 in which an operator rides is provided on the upper swing structure 102.

The front work device 103 includes a boom 2 as a work member mounted to a front portion of the upper swing structure 102 in a vertically rotatable manner, an arm 4 as a work member linked to a tip portion of the boom 2 in a vertically and front-rear directionally rotatable manner, a bucket 6 as a work member linked to a tip portion of the arm 4 in a vertically and front-rear directionally rotatable manner, a single rod-type hydraulic cylinder (hereinafter, referred to as boom cylinder) 1 that drives the boom 2, a single rod-type hydraulic cylinder (hereinafter, referred to as arm cylinder) 3 that drives the arm 4, and a single rod-type hydraulic cylinder (hereinafter referred, to as bucket cylinder) 5 that drives the bucket 6.

Figure 2:
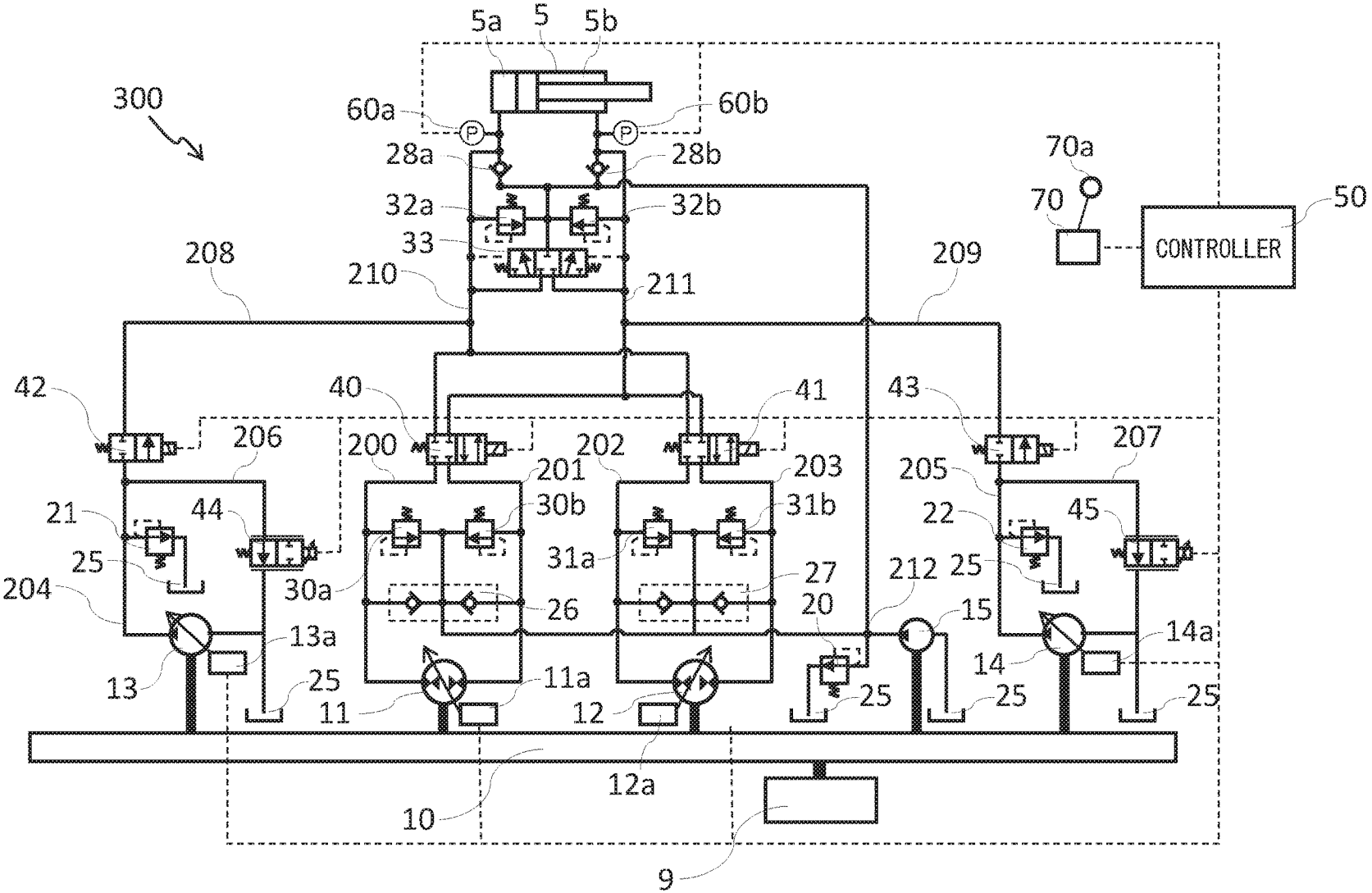
FIG. 2 is a schematic configuration diagram of a hydraulic drive system mounted on the hydraulic excavator depicted in FIG. 1.

FIG. 2 is a schematic configuration diagram of a hydraulic drive system mounted on the hydraulic excavator 100 depicted in FIG. 1. Note that for simplification of explanation, in FIG. 2, only those parts concerning the driving of the bucket cylinder 5 are denoted, and those parts concerning the driving of the other actuators are omitted.

In FIG. 2, a hydraulic drive system 300 includes: the bucket cylinder 5; an operation lever device 70 having a bucket lever 70*a* for operating the bucket cylinder 5 to extend and contract; an engine 9 as a power source; a power transmission mechanism 10 that distributes the power of the engine 9; first to fourth hydraulic pumps 11 to 14 and a charge pump 15 that are driven by the power distributed by the power transmission mechanism; first to fourth control valves 40 to 43 that selectively connect the first to fourth hydraulic pumps 11 to 14 to the bucket cylinder 5; a bottom-side proportional valve 44; a rod-side proportional valve 45; and a controller 50 as a control system.

The first and second hydraulic pumps 11 and 12 are bidirectional-type hydraulic pumps, which include a bidirectional tilting swash plate mechanism (not illustrated) having a pair of input/output ports and first and second regulators 11*a* and 12*a* for regulating the tilting angles (tilting amounts) of bidirectional tilting swash plates constituting the bidirectional tilting swash plate mechanism. In accordance with a control signal from the controller 50, the first and second regulators 11*a* and 12*a* regulates the tilting angles of the bidirectional tilting swash plates of the first and second hydraulic pumps 11 and 12, thereby to control the directions and flow rates of the working fluids delivered from the first and second hydraulic pumps 11 and 12.

The third and fourth hydraulic pumps 13 and 14 are single tilting-type hydraulic pumps, which include a single tilting swash plate mechanism (not illustrated) capable of delivering the working fluid in only a single direction and third and fourth regulators 13*a* and 14*a* for regulating the tilting angle of a single tilting swash plate constituting the single tilting swash plate mechanism. In accordance with a control signal from the controller 50, the third and fourth regulators 13*a* and 14*a* regulate the tilting angles of the single tilting swash plates of the third and fourth hydraulic pumps 13 and 14, thereby to control the flow rates of the working fluids delivered from the third and fourth hydraulic pumps 13 and 14.

The pair of input/output ports of the first hydraulic pump 11 is connected to the first control valve 40 through a pair of pump lines 200 and 201. The first hydraulic pump 11 sucks in the working fluid from one of the pair of pump lines 200 and 200, and delivers the working fluid into the other. The first control valve 40 is connected to the bottom chamber 5*a* of the bucket cylinder 5 through an actuator line 210, and is connected to the rod chamber 5*b* of the bucket cylinder 5 through an actuator line 211. Hereinafter, the actuator line 210 connected to the bottom chamber 5*a* will be referred to as bottom-side line, whereas the actuator line 211 connected to the rod chamber 5*b* will be referred to as rod-side line. The bucket cylinder 5 is extended when the working fluid is supplied into the bottom chamber 5*a* through the bottom-side line 210, and it is contracted when the working fluid is supplied into the rod chamber 5*b* through the rod-side line 211.

The first control valve 40 is switched to either of a communication position and an interruption position, in accordance with a control signal from the controller 50. Specifically, when the control signal is not outputted from the controller 50, the first control valve 40 is kept in the interruption position, and when the control signal is outputted from the controller 50, the first control valve 40 is switched to the communication position. When the first control valve 40 is in the communication position, the pump lines 200 and 201 and the actuator lines 210 and 211 communicate with each other, and the first hydraulic pump 11 and the bucket cylinder 5 are put into closed circuit connection.

The pair of input/output ports of the second hydraulic pump 12 are connected to the second control valve 41 through a pair of pump lines 202 and 203. The second hydraulic pump 12 sucks in the working fluid from one of the pair of pump lines 202 and 203, and delivers the working fluid into the other. The second control valve 41 is connected to the bottom chamber 5*a* of the bucket cylinder 5 through the bottom-side line 210, and is connected to the rod chamber 5*b* of the bucket cylinder 5 through the rod-side line 211.

The second control valve 41 is switched to either of a communication position and an interruption position, in accordance with a control signal from the controller 50. Specifically, when the control signal is not outputted from the controller 50, the second control valve 41 is kept in the interruption position, and when the control signal is outputted from the controller 50, the second control valve 41 is switched to the communication position. When the second control valve 41 is in the communication position, the pump lines 202 and 203 and the actuator lines 210 and 211 communicate with each other, and the second hydraulic pump 12 and the bucket cylinder 5 are put into closed circuit connection.

A delivery port of the third hydraulic pump 13 is connected to the third control valve 42 through a pump line 204. A suction port of the third hydraulic pump 13 is connected to the working fluid tank 25. The third hydraulic pump 13 sucks in the working fluid from the working fluid tank 25, and delivers the working fluid into the pump line 204. The pump line 204 is connected to the working fluid tank 25 via a relief valve 21. The relief valve 21 relieves the working fluid in the pump line 204 into the working fluid tank 25 when the pressure in the pump line 204 exceeds a predetermined pressure (relief pressure Pmax), thereby protecting the circuit. The pump line 204 is connected to the working fluid tank 25 through a tank line 206, and the tank line 206 is provided with the bottom-side proportional valve 44. The third control valve 42 is connected to the bottom-side line 210 through a bottom-side branch line 208. The bottom-side branch line 208, the tank line 206 and part of the pump line 204 (that part which connects the third control valve 42 and the tank line 206) connect the bottom-side line 210 and the working fluid tank 25, to constitute a bottom-side discharge line for discharging the working fluid in the bottom chamber 5*a* of the bucket cylinder 5 into the working fluid tank 25.

The third control valve 42 is switched to either of a communication position and an interruption position, in accordance with a control signal from the controller 50. Specifically, when the control signal is not outputted from the controller 50, the third control valve 42 is kept in the interruption position, and when the control signal is outputted from the controller 50, the third control valve 42 is switched to the communication position. When the third control valve 42 is in the communication position, the third hydraulic pump 13 is connected to the bottom chamber 5*a* of the bucket cylinder 5 through the pump line 204, the bottom-side branch line 208 and the bottom-side line 210. The third hydraulic pump 13 can assist an extending operation of the bucket cylinder 5, by supplying the working fluid into the bottom chamber 5*a* of the bucket cylinder 5, together with the first hydraulic pump 11.

The bottom-side proportional valve 44 is operated between a full-open position and a full-closed position, to vary the opening area, in accordance with a control signal from the controller 50. Specifically, when the control signal is not outputted from the controller 50, the bottom-side proportional valve 44 is kept in the full-open position, and when the control signal is outputted from the controller 50, the bottom-side proportional valve 44 is operated from the full-open position to the full-closed position in accordance with the control signal, whereby the opening area is varied between a maximum opening area and zero. In addition, when the third control valve 42 is in the interruption position, the controller 50 controls the bottom-side proportional valve 44 such as to obtain an opening area preset according to the delivery flow rate of the third hydraulic pump 13.

A delivery port of the fourth hydraulic pump 14 is connected to the fourth control valve 43 through a pump line 205. A suction port of the fourth hydraulic pump 14 is connected to the working fluid tank 25. The fourth hydraulic pump 14 sucks in the working fluid from the working fluid tank 25, and delivers the working fluid into the pump line 205. The pump line 205 is connected to the working fluid tank 25 through a relief valve 22. The relief valve 22 relieves the working fluid in the pump line 205 into the working fluid tank 25 when the pressure in the pump line 205 exceeds a predetermined pressure (relief pressure Pmax), thereby protecting the circuit. The pump line 205 is connected to the working fluid tank 25 through a tank line 207, and the tank line 207 is provided with the rod-side proportional valve 45. The fourth control valve 43 is connected to the rod-side line 211 through a rod-side branch line 209. The rod-side branch line 209, the tank line 207 and part of the pump line 205 (that part which connects the fourth control valve 43 and the tank line 207) connect the rod-side line 211 and the working fluid tank 25, to constitute a rod-side discharge line for discharging the working fluid in the rod chamber 5*b* of the bucket cylinder 5 into the working fluid tank 25.

The fourth control valve 43 is switched to either of a communication position and an interruption position, in accordance with a control signal from the controller 50. Specifically, when the control signal is not outputted from the controller 50, the fourth control valve 43 is kept in the interruption position, and when the control signal is outputted from the controller 50, the fourth control valve 43 is switched to the communication position. When the fourth control valve 43 is in the communication position, the fourth hydraulic pump 14 is connected to the rod chamber 5*b* of the bucket cylinder 5 through the pump line 205, the rod-side branch line 209 and the rod-side line 211. The fourth hydraulic pump 14 can assist a contracting operation of the bucket cylinder 5, by supplying the working fluid into the rod chamber 5*b* of the bucket cylinder 5, together with the second hydraulic pump 12.

The rod-side proportional valve 45 is operated between a full-open position and a full-closed position, to vary the opening area, in accordance with a control signal from the controller 50. Specifically, when the control signal is not outputted from the controller 50, the rod-side proportional valve 45 is kept in the full-open position, and when the control signal is outputted from the controller 50, the rod-side proportional valve 45 is operated from the full-open position to the full-closed position side in accordance with the control signal, whereby the opening area is varied between a maximum opening area to zero. In addition, when the fourth control valve 43 is in the interruption position, the controller 50 controls the rod-side proportional valve 45 such as to obtain an opening area preset according to the delivery flow rate of the fourth hydraulic pump 14.

The charge pump 15 is a fixed displacement hydraulic pump, sucks in the working fluid from the working fluid tank 25, and delivers the working fluid into a charge line 212. The charge line 212 is connected to the working fluid tank 25 via a charge relief valve 20. The charge relief valve 20 relieves the working fluid in the charge line 212 into the working fluid tank 25 when the pressure in the charge line 212 exceeds a predetermined pressure (charge pressure Pch), whereby the pressure in the charge line 212 is kept at a constant pressure (charge pressure Pch).

The pump lines 200 and 201 of the first hydraulic pump 11 are connected to the charge line 212 through a charge check valve 26. The charge check valve 26 supplies the working fluid in the charge line 212 into the pump lines 200 and 201 when the pressure in the pump lines 200 and 201 decreases below the pressure (charge pressure Pch) in the charge line 212. In addition, the pump lines 200 and 201 are connected to the charge line 212 via relief valves 30*a* and 30*b*. The relief valves 30*a* and 30*b* relieve the working fluid in the pump lines 200 and 201 into the charge line 212 when the pressure in the pump lines 200 and 201 exceeds a predetermined pressure (relief pressure Pmax), thereby protecting the circuit.

The pump lines 202 and 203 of the second hydraulic pump 12 are connected to the charge line 212 through a charge check valve 27. The charge check valve 27 supplies the working fluid in the charge line 212 into the pump lines 202 and 203 when the pressure in the pump lines 202 and 203 decreases below the pressure (charge pressure Pch) in the charge line 212. In addition, the pump lines 202 and 203 are connected to the charge line 212 via relief valves 31*a* and 31*b*. The relief valves 31*a* and 31*b* relieve the working fluid in the pump lines 200 and 201 into the charge line 212 when the pressure in the pump lines 202 and 203 exceeds a predetermined pressure (relief pressure Pmax), thereby protecting the circuit.

The actuator lines 210 and 211 are connected to the charge line 212 through charge check valves 28*a* and 28*b*. The charge check valves 28*a* and 28*b* supply the working fluid in the charge line 212 into the actuator lines 210 and 211 when the pressure in the actuator lines 210 and 211 decreases below the pressure (charge pressure Pch) in the charge line 212. In addition, the actuator lines 210 and 211 are connected to the charge line 212 via relief valves 32*a* and 32*b*. The relief valves 32*a* and 32*b* relieve the working fluid in the actuator lines 210 and 211 into the charge line 212 when the pressure in the actuator lines 210 and 211 exceeds a predetermined pressure (relief pressure Pmax), thereby protecting the circuit.

Further, the actuator lines 210 and 211 are connected to the charge line 212 through a flushing valve 33. When the differential pressure between the bottom-side line 210 and the rod-side line 211 exceeds a predetermined pressure (switching pressure Psw), the flushing valve 33 establishes communication between the lower pressure side of the actuator lines 210 and 211 and the charge line 212, to discharge a surplus flow rate on the lower pressure side of the actuator lines 210 and 211 into the charge line 212.

The bottom-side line 210 is provided with a first pressure sensor 60*a* as a bottom pressure sensor. The first pressure sensor 60*a* converts the pressure in the bottom-side line 210 (the pressure in the bottom chamber 5*a*) into a pressure signal, and outputs the pressure signal to the controller 50. In addition, the rod-side line 211 is provided with a second pressure sensor 60*b* as a rod pressure sensor. The second pressure sensor 60*b* converts the pressure in the rod-side line 211 (the pressure in the rod chamber 5*b*) into a pressure signal, and outputs the pressure signal to the controller 50.

The operation lever device 70 outputs an operation signal according to an operation of the bucket lever 70*a* to the controller 50. The controller 50 controls the first to fourth control valves 40 to 43, the bottom-side proportional valve 44, the rod-side proportional valve 45 and the first to fourth regulators 11*a* to 14*a*, based on the operation signal from the operation lever device 70 and the pressure signals from the first and second pressure sensors 60*a* and 60*b*.

Figure 3:
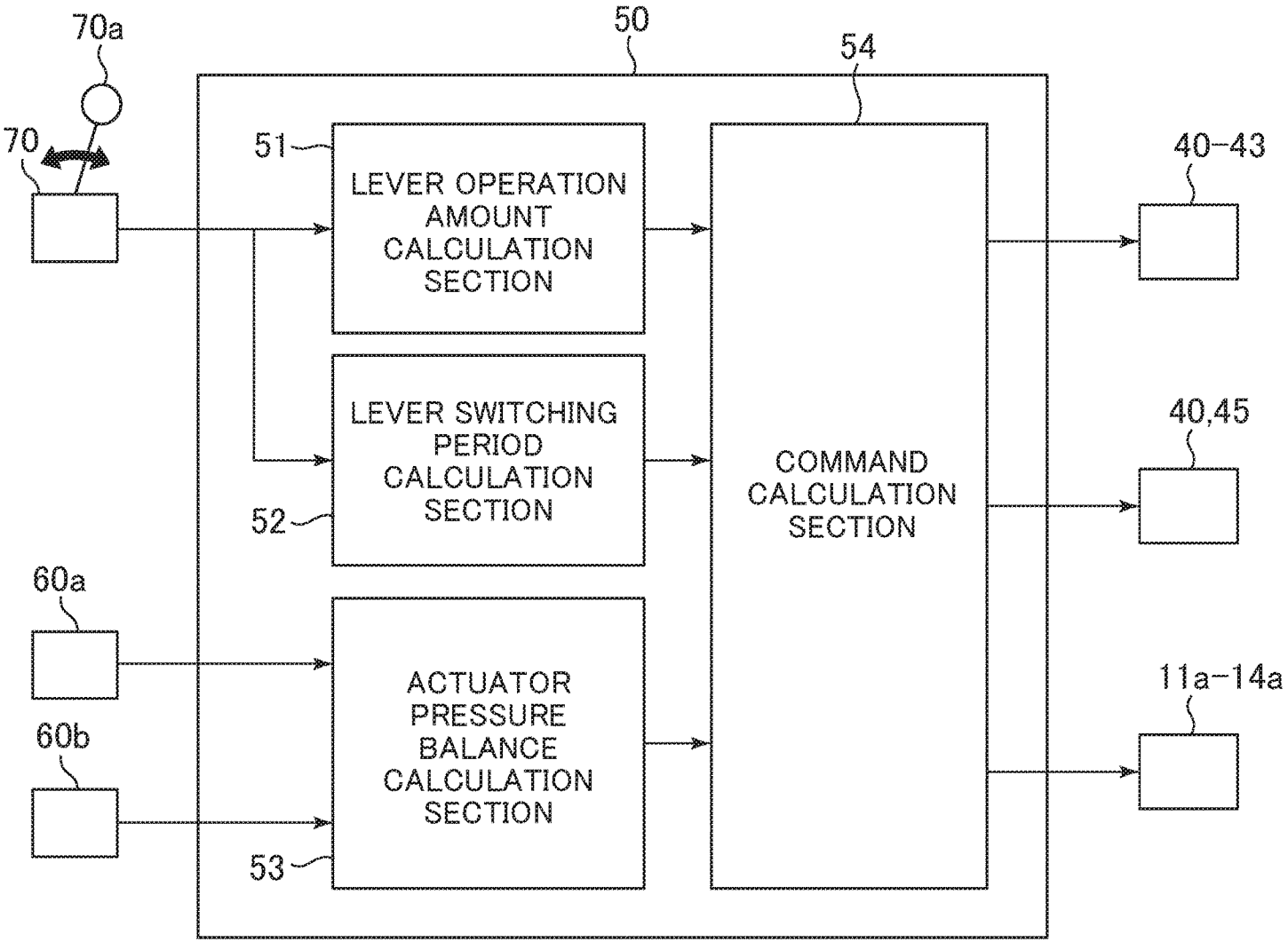
FIG. 3 is a functional block diagram of a controller depicted in FIG. 2.

FIG. 3 is a functional block diagram of the controller 50 depicted in FIG. 2. Note that for simplification of explanation, in FIG. 3, only those parts concerning the driving of the bucket cylinder 5 are depicted, and those parts concerning the driving of the other actuators are omitted.

In FIG. 3, the controller 50 includes a lever operation amount calculation section 51, a lever switching period calculation section 52, an actuator pressure balance calculation section 53, and a command calculation section 54.

The lever operation amount calculation section 51 calculates an operating direction and a target operation speed of the bucket cylinder 5, based on the operation signal inputted from the operation lever device 70 (the operation amount of the bucket lever 70*a*), and outputs the calculation results to the command calculation section 54.

The lever switching period calculation section 52 calculates a time (lever switching period) required for the bucket lever 70*a* to reciprocate between the side of extending the bucket cylinder 5 and the side of contracting the bucket cylinder 5, based on the operation signal inputted from the operation lever device 70 (the operation amount of the bucket lever 70*a*), and outputs the calculation result to the command calculation section 54.

The actuator pressure balance calculation section 53 calculates a balance between the bottom pressure and the rod pressure of the bucket cylinder 5 (for example, the differential pressure between the bottom pressure and the rod pressure), based on the pressure signals from the first and second pressure sensors 60*a* and 60*b*, and outputs the calculation result to the command calculation section 54.

The command calculation section 54 calculates open/closed states of the first and second control valves 40 and 41, opening areas of the bottom-side proportional valve 44 and the rod-side proportional valve 45, and delivery flow rates of the first to fourth hydraulic pumps 11 to 14, based on the calculation results outputted from the lever operation amount calculation section 51, the lever switching period calculation section 52 and the actuator pressure balance calculation section 53, and outputs control signals to the first to fourth control valves 40 to 43, the bottom-side proportional valve 44, the rod-side proportional valve 45 and the first to fourth regulators 11*a* to 14*a*.

Figure 4:
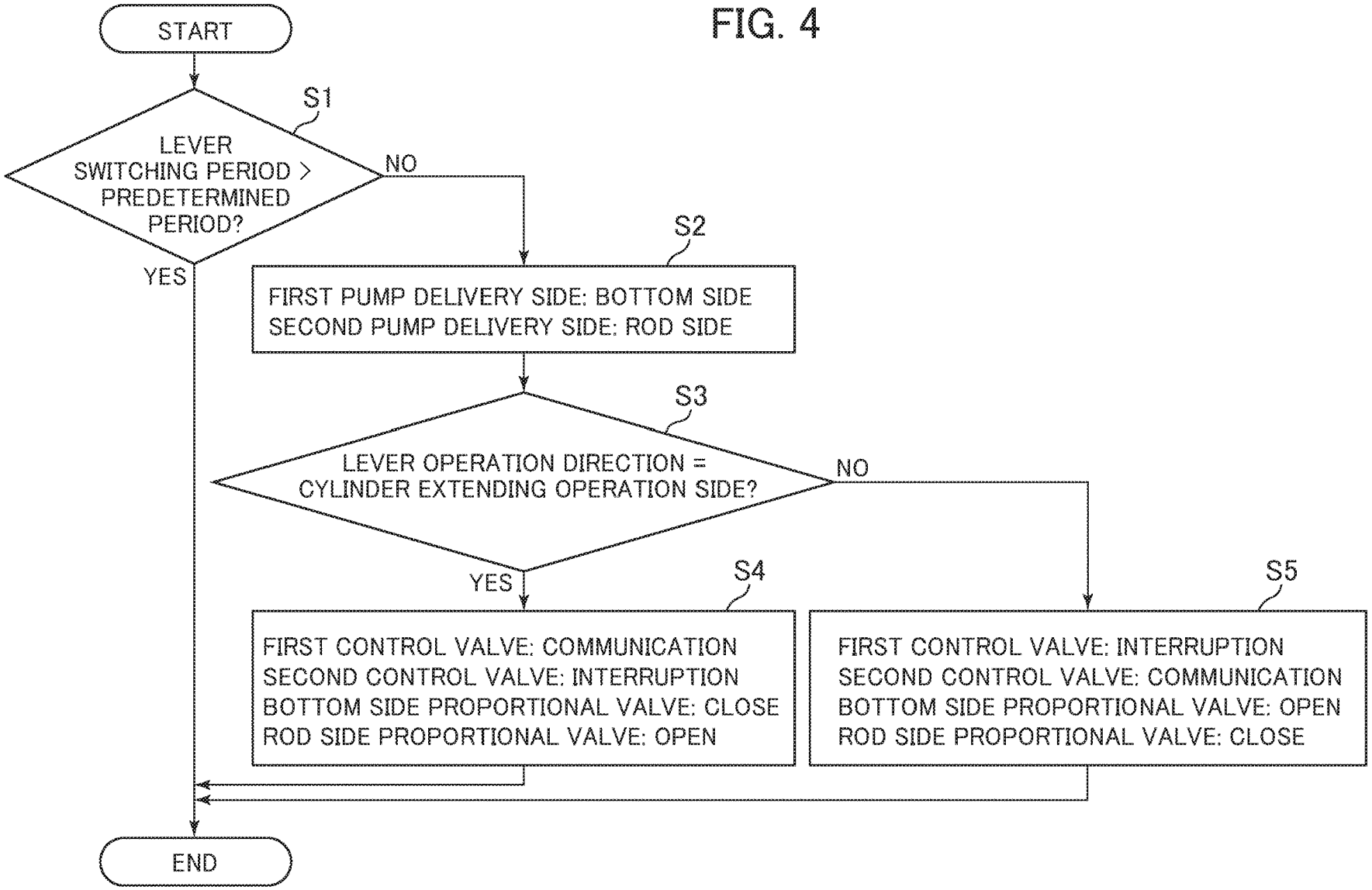
FIG. 4 is a flow chart depicting control of first to fourth control valves, a bottom-side proportional valve and a rod-side proportional valve in one control period of the controller depicted in FIG. 2.

FIG. 4 is a flow chart depicting control of the first and second control valves 40 and 41, the bottom-side proportional valve 44 and the rod-side proportional valve 45 in one control period of the controller 50. Note that for simplification of explanation, in FIG. 4, only those processings concerning a high-speed switching operation of the bucket lever 70*a* are depicted, and those processings concerning the other operations are omitted. The steps constituting the control flow will be sequentially described below.

First, in step S1, it is determined whether or not the switching period of the bucket lever 70*a* is greater than a predetermined period, based on operation signals from the operation lever device 70. Here, the predetermined period is set, for example, based on the switching period of the bucket lever 70*a* at the time of a bucket mud dropping operation.

If it is determined in step S1 that the lever switching period is greater than the predetermined period (YES), the current control period is finished, and the control shifts to the next control period.

If it is determined in step S1 that the lever switching period is equal to or less than the predetermined period (NO), the first regulator 11*a* is controlled such that the delivery side of the first hydraulic pump 11 is the bottom side, and the second regulator 12*a* is controlled such that the delivery side of the second hydraulic pump 12 is the rod side, in step S2. As a result, the first and second control valves 40 and 41 are alternately opened, whereby the driving direction of the bucket cylinder 5 can be switched at high speed.

In step S3, subsequent to step S2, it is determined whether or not the operating direction of the bucket lever 70*a* is on the side of extending the bucket cylinder 5.

If it is determined in step S3 that the operating direction of the bucket lever 70*a* is on the side of extending the bucket cylinder 5 (YES), the first control valve 40 is switched to the communication position, the second control valve 41 is switched to the interruption position, the bottom-side proportional valve 44 is closed, and the rod-side proportional valve 45 is opened, in step S4. As a result, all the delivery flow rates of the first and third hydraulic pumps 11 and 13 flow into the bottom chamber 5*a*, part of the discharge flow rate from the rod chamber 5*b* is absorbed by the first hydraulic pump 11, the remaining part of the discharge flow rate from the rod chamber 5*b* is returned to the working fluid tank 25 through the rod-side proportional valve 45, and the bucket cylinder 5 is extended.

If it is determined in step S3 that the operating direction of the bucket lever 70*a* is on the side of contracting the bucket cylinder 5 (NO), the first control valve 40 is switched to the interruption position, the second control valve 41 is switched to the communication position, the bottom-side proportional valve 44 is opened, and the rod-side proportional valve 45 is closed, in step S5. As a result, all the delivery flow rates of the second and fourth hydraulic pumps 12 and 14 flow into the rod chamber 5*b*, part of the discharge flow rate from the bottom chamber 5*a* is absorbed by the second hydraulic pump 12, the remaining part of the discharge flow rate from the bottom chamber 5*a* is returned to the working fluid tank 25 through the bottom-side proportional valve 44, and the bucket cylinder 5 is contracted.

When step S4 or S5 is finished, the current control period is finished, and the control shifts to the next control period.

An operation of the hydraulic drive system 300 configured as above will be described.

(1) When Bucket is Not Operated

In FIG. 2, when the bucket lever 70*a* is not operated, the tilting angles of the first to fourth hydraulic pumps 11 to 14 is controlled to a minimum tilting angle, and the first to fourth control valves 40 to 43 are all closed. As a result, neither of the bottom chamber 5*a* and the rod chamber 5*b* of the bucket cylinder 5 is supplied with the working fluid, and the bucket cylinder 5 maintains a stopped state.

(2) At the Time of Bucket Mud Dropping Operation

Figure 5:
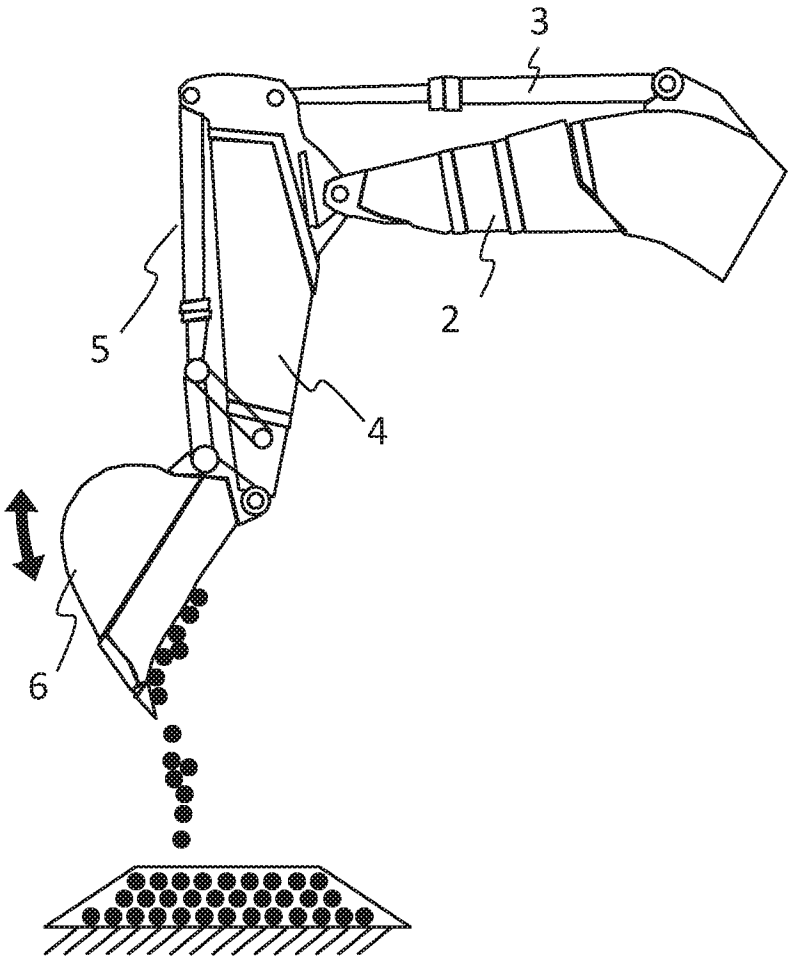
FIG. 5 is a figure depicting a front work device at the time of a bucket mud dropping operation.

In the hydraulic excavator 100, for dropping mud and the like adhering to the bucket 6, an operation of shaking the bucket 6 up and down (bucket mud dropping operation) is conducted in a state in which the arm 4 is held vertical and the bucket cylinder 5 is contracted to the vicinity of a stroke end (a state in which the center of gravity of the bucket 6 is located on the bucket cylinder 5 side as compared to a linking portion between the arm 4 and the bucket 6), as depicted in FIG. 5. In this instance, for extending and contracting the bucket cylinder 5 at high speed, the operator performs an operation of switching the bucket lever 70*a* at high speed between the side of extending the bucket cylinder 5 and the side of contracting the bucket cylinder 5 (high-speed lever switching operation).

Figure 6:
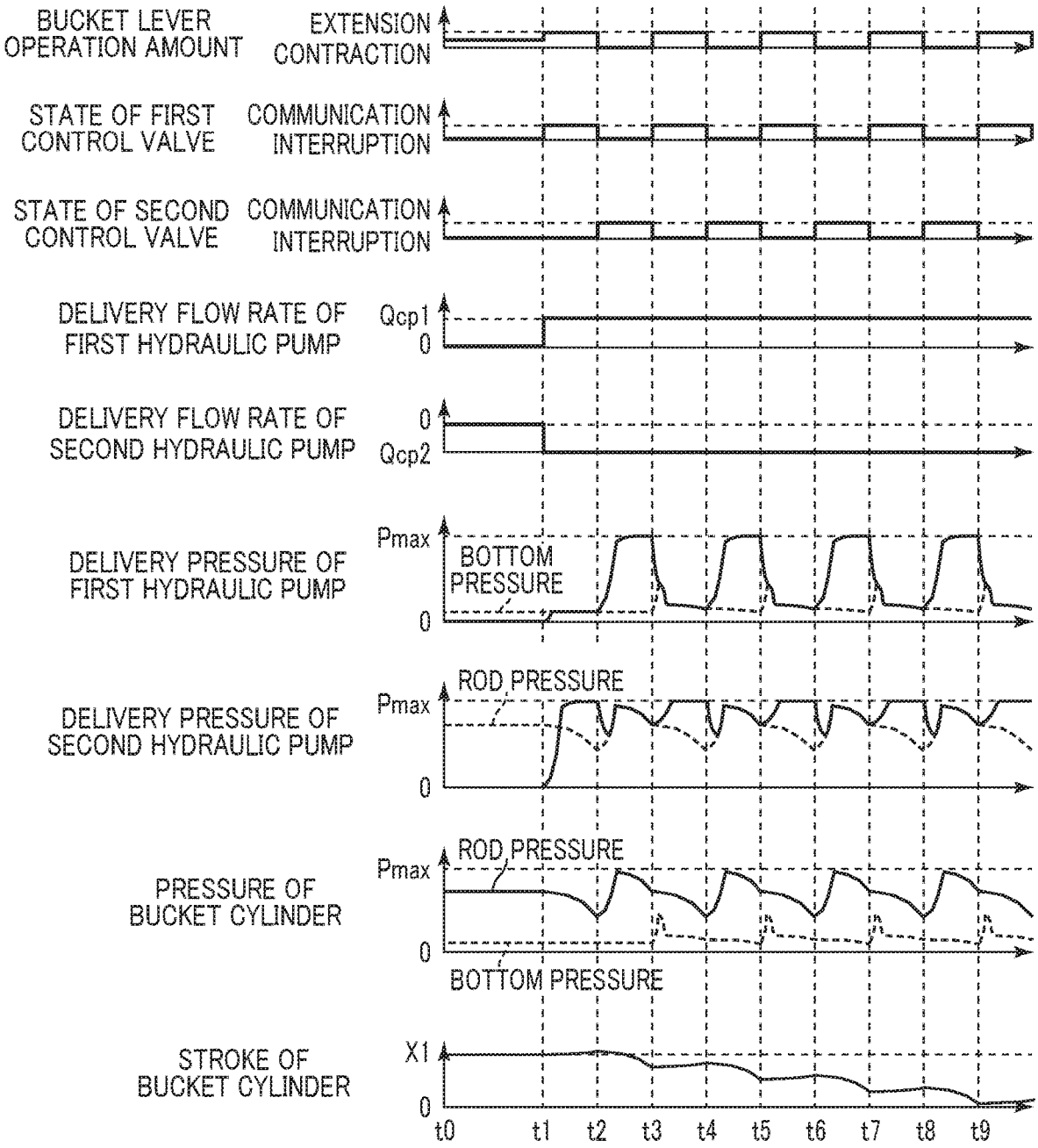
FIG. 6 (PRIOR ART)
FIG. 6 is a figure depicting an operation at the time of a bucket mud dropping operation of a hydraulic drive system to which control of the prior art is applied.

In the first place, an operation at the time of the bucket mud dropping operation of a hydraulic drive system 300 to which control according to the prior art is applied will be described referring to FIG. 6.

From time t0 to time t1, the bucket cylinder 5 is in a quiet settled state. In this instance, the arm 4 is held vertical, and the center of gravity of the bucket 6 is located on the bucket cylinder 5 side as compared to a connection portion between the arm 4 and the bucket 6, so that the rod pressure of the bucket cylinder 5 is higher than the bottom pressure of the bucket cylinder 5. Therefore, the bottom-side line 210 on the lower pressure side communicates with the charge line 212 through the flushing valve 33, and the bottom pressure of the bucket cylinder 5 becomes equal to a set pressure (charge pressure Pch) of the charge relief valve 20.

From time t1 to time t2, the bucket lever 70*a* is operated to the side of extending the bucket cylinder 5, and from time t2 to time t3, the bucket lever 70*a* is operated to the side of contracting the bucket cylinder 5.

At time t1, the controller 50 controls the first regulator 11*a* such that the first hydraulic pump 11 delivers the working fluid to the bottom-side pump line 200 at a predetermined flow rate Qcp1.

At time t1, the controller 50 controls the second regulator 12*a* such that the second hydraulic pump 12 delivers the working fluid to the rod-side pump line 203 at a predetermined flow rate Qcp2.

At time t1, the controller 50 switches the first control valve 40 from an interruption state to a communication state.

At time t1, the controller 50 keeps the second control valve 41 in an interruption state.

From time t1 to time t2, the delivery pressure of the second hydraulic pump 12 is equal to a set pressure (relief pressure Pmax) of the relief valve 31*b*, since the second control valve 41 is in the interruption state.

From time t1 to time t2, the first control valve 40 is in the communication state, and, therefore, the bottom chamber 5*a* of the bucket cylinder 5 is connected to the delivery side of the first hydraulic pump 11 through the bottom-side line 210, the first control valve 40 and the pump line 200. On the other hand, the rod chamber 5*b* of the bucket cylinder 5 is connected to the suction side of the first hydraulic pump 11 through the rod-side line 211, the first control valve 40 and the pump line 201.

From time t1 to time t2, the first hydraulic pump 11 delivers the flow rate sucked in from the pump line 201 into the pump line 200. The delivery pressure of the first hydraulic pump 11 is synchronized with and substantially equal to the bottom pressure of the bucket cylinder 5.

From time t1 to time t2, the rod chamber 5*b* of the bucket cylinder 5 is connected to the suction side of the first hydraulic pump 12, and, therefore, the working fluid in the rod chamber 5*b* of the bucket cylinder 5 is sucked out, and the rod pressure is lowered. Although the bottom chamber 5*a* of the bucket cylinder 5 is connected to the delivery side of the first hydraulic pump 11, the flow rate delivered at the first hydraulic pump 11 flows into the bottom-side line 210 through the pump line 200 and the first control valve 40. Here, since the rod pressure is higher than the bottom pressure and the differential pressure is greater than the switching pressure Psw of the flushing valve 33, the bottom-side line 210 on the lower pressure side is communicating with the charge line 212 through the flushing valve 33. Accordingly, part of the working fluid in the bottom-side line 210 flows out into the charge line 212, and the bottom pressure of the bucket cylinder 5 is kept at the charge pressure Pch. As a result, a force for driving the bucket cylinder 5 to the extending side cannot swiftly overcome frictional resistance of the bucket cylinder 5 and the like, and the cylinder stroke of the bucket cylinder 5 is little increased with the operation amount of the bucket lever 70*a*.

At time t2, the controller 50 switches the first control valve 40 from the communication state to the interruption state.

At time t2, the controller 50 switches the second control valve 41 from the interruption state to the communication state.

From time t2 to time t3, the delivery pressure of the first hydraulic pump 11 is equal to a set pressure (relief pressure Pmax) of the relief valve 30*a*, since the first control valve 40 is in the interruption state.

From time t2 to time t3, the bottom chamber 5*a* of the bucket cylinder 5 is connected to the suction side of the second hydraulic pump 12 through the bottom-side line 210, the second control valve 41 and the pump line 202, since the second control valve 41 is in the communication state. On the other hand, the rod chamber 5*b* of the bucket cylinder 5 is connected to the delivery side of the second hydraulic pump 12 through the rod-side line 211, the second control valve 41 and the pump line 203.

From time t2 to time t3, the second hydraulic pump 12 delivers the flow rate sucked in from the pump line 202 into the pump line 203. The delivery pressure of the second hydraulic pump 12 is synchronized with and substantially equal to the rod pressure of the bucket cylinder 5.

At time t2, the working fluid at a high pressure in the pump line 203 which has been raised in pressure from time t1 to time t2 flows into the rod chamber 5*b* of the bucket cylinder 5 through the rod-side line 211.

From time t2 to time t3, the delivery flow rate from the second hydraulic pump 12 flows into the rod chamber 5*b* of the bucket cylinder 5 through the pump line 203, the second control valve 41 and the rod-side line 211, whereby the rod pressure of the bucket cylinder 5 is raised.

From time t2 to time t3, the rod pressure is higher than the bottom pressure and the differential pressure is greater than the switching pressure Psw of the flushing valve 33, and, therefore, the bottom-side line 210 on the lower pressure side communicates with the charge line 212 through the flushing valve 33.

From time t2 to time t3, the bottom side of the bucket cylinder 5 is connected to the suction side of the second hydraulic pump 12.

From time t2 to time t3, even in the case where a discharge flow rate from the bottom chamber 5*a* of the bucket cylinder 5 is absent, when the pressure in the pump line 202 and the bottom-side line 210 is reduced to or below the charge pressure Pch, the working fluid flows in from the charge line 212 through the charge check valves 27 and 28*a*, whereby the bottom pressure of the bucket cylinder 5 is kept at the charge pressure Pch.

From time t2 to time t3, the bottom pressure of the bucket cylinder 5 is higher than the rod pressure of the bucket cylinder 5 and the differential pressure is greater, as compared to the quiet settled state from time t0 to time t1; therefore, a force for driving the bucket cylinder 5 to the contracting side swiftly overcomes the frictional resistance of the bucket cylinder 5 and the like, so that the cylinder stroke is reduced in accordance with the operation amount of the bucket lever 70*a*.

Operations after time t3 are the same as the operations from time t1 to time t3, and, therefore, description thereof will be omitted.

Figure 7:
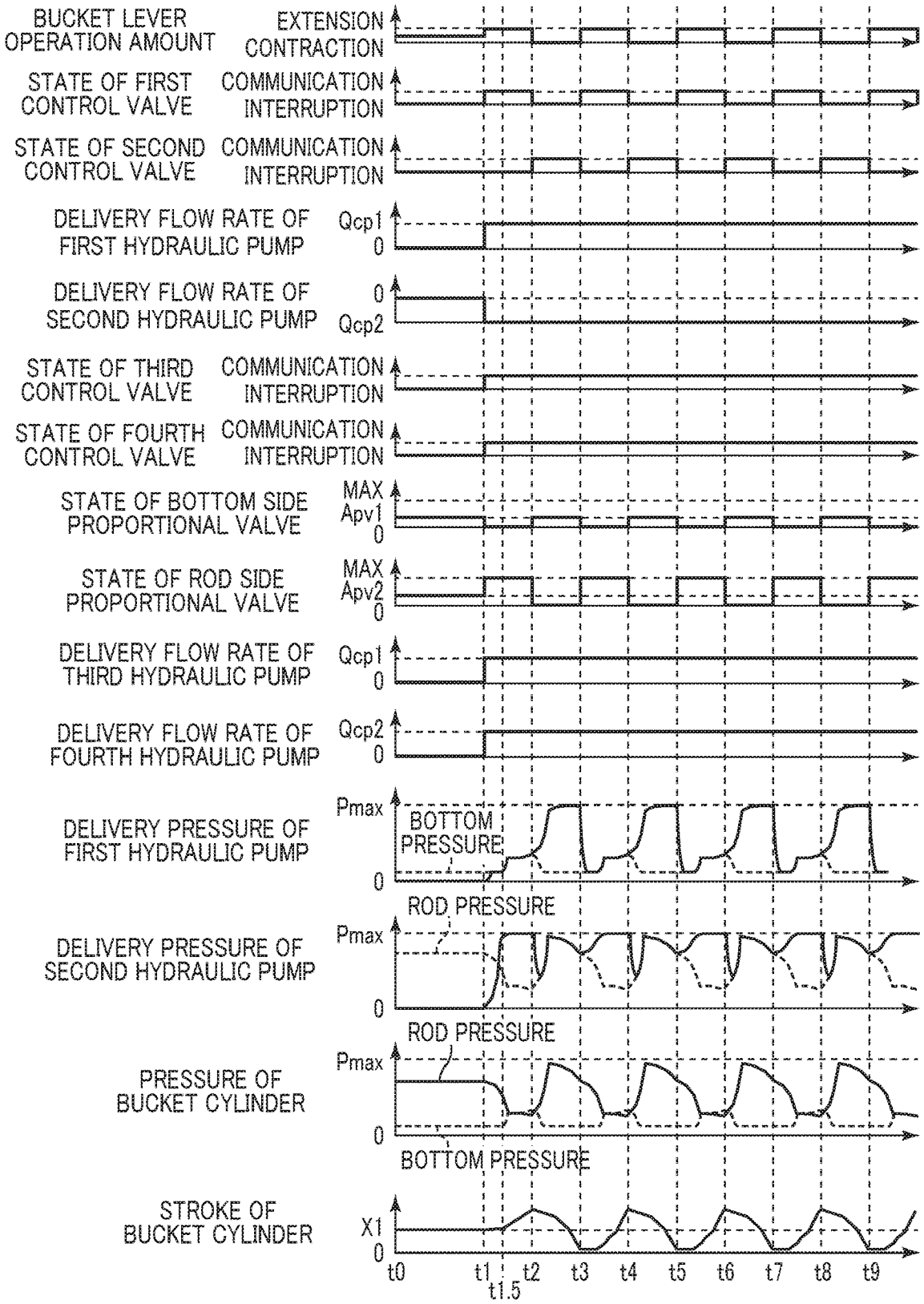
FIG. 7 is a figure depicting an operation at the time of the bucket mud dropping operation of the hydraulic drive system according to the embodiment of the present invention.

In the next place, an operation at the time of the bucket mud dropping operation of the hydraulic drive system 300 according to the present embodiment will be described referring to FIG. 7. Note that differences from the operation in the case where the aforementioned prior art is applied (depicted in FIG. 6) will be described, and repeated descriptions will be omitted.

At time t1, the controller 50 controls the third regulator 13*a* such that the third hydraulic pump 13 delivers the working fluid into the pump line 204 at a predetermined flow rate Qop1.

At time t1, the controller 50 controls the fourth regulator 14*a* such that the fourth hydraulic pump 13 delivers the working fluid into the pump line 205 at a predetermined flow rate Qop2.

At time t1, the controller 50 switches the third control valve 42 from an interruption state to a communication state.

At time t1, the controller 50 switches the fourth control valve 43 from an interruption state to a communication state.

At time t1, the controller 50 switches the opening area of the bottom-side proportional valve 44 from an opening area Apv1 at which a preset delivery flow rate Qop1 of the third hydraulic pump 13 can pass with a pressure loss comparable to the charge pressure Pch to zero.

At time t1, the controller 50 switches the opening area of the rod-side proportional valve 45 from an opening area Apv2 at which a preset delivery flow rate Qop2 from the fourth hydraulic pump 14 can pass with a pressure loss comparable to the charge pressure Pch to a maximum opening area MAX.

After time t1, since the third control valve 42 is in the communication state, the bottom chamber 5*a* of the bucket cylinder 5 is connected to the third hydraulic pump 13 and the bottom-side proportional valve 44 through the bottom-side line 210, the third control valve 42 and the pump line 204.

After time t1, the delivery pressure of the third hydraulic pump 13 is synchronized with and substantially equal to the bottom pressure of the bucket cylinder 5.

After time t1, since the fourth control valve 43 is in the communication state, the rod chamber 5*b* of the bucket cylinder 5 is connected to the fourth hydraulic pump 14 and the rod-side proportional valve 45 through the rod-side line 211, the fourth control valve 43 and the pump line 205.

After time t1, the delivery pressure of the fourth hydraulic pump 14 is synchronized with and substantially equal to the rod pressure of the bucket cylinder 5.

From time t1 to time t1.5, the rod chamber 5*b* of the bucket cylinder 5 is connected to the suction side of the second hydraulic pump 12 and, further, the rod-side proportional valve 45 has a maximum opening area; therefore, the working fluid in the rod chamber 5*b* of the bucket cylinder 5 is sucked out in a large quantity, and the rod pressure is suddenly lowered.

From time t1 to time t1.5, since the bottom side of the bucket cylinder 5 is connected to the delivery side of the first hydraulic pump 11, the delivery flow rate of the first hydraulic pump 11 flows into the bottom-side line 210 through the pump line 200 and the first control valve 40. Here, since the bottom-side line 210 is communicating with the charge line 212 through the flushing valve 33, the bottom pressure of the bucket cylinder 5 is kept at the charge pressure Pch.

From time t1 to time t1.5, since the rod pressure of the bucket cylinder 5 is higher than the bottom pressure of the bucket cylinder 5 and the differential pressure is great, a force for driving the bucket cylinder 5 to the extending side cannot overcome the frictional resistance of the bucket cylinder 5 and the like, so that the stroke of the bucket cylinder 5 is little increased with the operation amount of the bucket lever 70*a*.

At time t1.5, when the differential pressure between the bottom pressure and the rod pressure of the bucket cylinder 5 is reduced to or below the switching pressure Psw of the flushing valve 33, the flushing valve 33 is returned into a neutral position, and the communication between the bottom-side line 210 and the charge line 212 is interrupted.

From time t1.5 to time t2, the delivery flow rate of the first hydraulic pump 11 flows into the bottom chamber 5*a* of the bucket cylinder 5 through the pump line 200, the first control valve 40 and the bottom-side line 210. Here, since the communication between the bottom-side line 210 and the charge line 212 is interrupted, the bottom pressure rises above the charge pressure Pch.

From time t1.5 to time t2, since the bottom pressure of the bucket cylinder 5 is higher than the rod pressure, a force for driving the bucket cylinder 5 to the extending side swiftly overcomes the frictional resistance and the like, and the stroke is increased according to the operation amount of the bucket lever 70*a*.

At time t2, the controller 50 switches the opening area of the bottom-side proportional valve 44 from zero to a predetermined opening area Apv1.

At time t2, the controller 50 switches the opening area of the rod-side proportional valve 45 from a maximum opening area MAX to zero.

From time t2 to time t3, the delivery flow rate of the second hydraulic pump 12 flows into the rod chamber 5*b* of the bucket cylinder 5 through the pump line 203, the second control valve 41 and the rod-side line 211, and, further, the delivery flow rate of the fourth hydraulic pump 14 flows into the rod chamber 5*b* of the bucket cylinder 5 through the pump line 205, the fourth control valve 43 and the rod-side line 211, whereby the rod pressure is raised.

Operations after time t3 are the same as the operation from time t1 to time t3, and, therefore, description thereof will be omitted.

Effects obtained by the hydraulic excavator 100 according to the present embodiment will be described below.

In the hydraulic drive system 300 to which the control of the prior art is applied, when the bucket lever 70*a* is switched from the side of contracting the bucket cylinder 5 to the side of extending the bucket cylinder 5, the working fluid is supplied from the first hydraulic pump 11 into the bottom chamber 5*a* of the bucket cylinder 5 through the bottom-side line 210, but, since the bottom-side line 210 on the lower pressure side is connected to the charge line 212, the pressure in the bottom chamber 5*a* cannot be raised above the charge pressure Pch, so that the force for driving the bucket cylinder 5 to the extending side cannot overcome the frictional resistance of the bucket cylinder 5 and the like. Therefore, as depicted in FIG. 6, at the time of a high-speed lever operation, the cylinder stroke is little increased in response to a lever operation on the side of extending the bucket cylinder 5, and responsiveness of the bucket cylinder 5 is lowered.

On the other hand, in the hydraulic excavator 100 according to the present embodiment, when the bucket lever 70*a* is switched from the side of extending the bucket cylinder 5 to the side of contracting the bucket cylinder 5 in a state in which the rod pressure of the bucket cylinder 5 is higher than the bottom pressure of the bucket cylinder 5, the rod-side proportional valve 45 is opened, and part of the working fluid in the rod chamber 5*b* is discharged into the working fluid tank 25, and, therefore, the rod pressure is swiftly lowered. Then, with the differential pressure between the bottom pressure and the rod pressure decreasing below the switching pressure Psw of the flushing valve 33, the flushing valve 33 is returned into the neutral position, and the communication between the bottom-side line 210 and the working fluid tank 25 is interrupted. Then, all the delivery flow rate of the first hydraulic pump 11 flows into the bottom chamber 5*a*, whereby the bottom pressure is speedily raised. As a result, when a high-speed lever switching operation is conducted in a state in which the rod pressure of the bucket cylinder 5 is higher than the bottom pressure of the bucket cylinder 5, the force for driving the bucket cylinder 5 to the extending side swiftly overcomes the frictional resistance of the bucket cylinder 5 and the like, and the cylinder stroke is increased according to the lever operation amount on the side of extending the bucket cylinder 5, resulting in that responsiveness of the bucket cylinder 5 can be enhanced.

In addition, when the bucket lever 70*a* is switched from the side of extending the bucket cylinder 5 to the side of contracting the bucket cylinder 5 in a state in which the bottom pressure of the bucket cylinder 5 is higher than the rod pressure of the bucket cylinder 5, the bottom-side proportional valve 44 is opened, and part of the working fluid in the bottom chamber 5*a* is discharged into the working fluid tank 25, so that the bottom pressure is lowered speedily. Then, the differential pressure between the bottom pressure and the rod pressure is reduced below the switching pressure Psw of the flushing valve 33, whereby the flushing valve 33 is returned into a neutral position, and the communication between the rod-side line 211 and the working fluid tank 25 is interrupted. Then, all the delivery flow rate of the first hydraulic pump 11 flows into the rod chamber 5*b*, whereby the rod pressure is swiftly raised. As a result, when a high-speed lever switching operation is conducted in a state in which the bottom pressure of the bucket cylinder 5 is higher than the rod pressure of the bucket cylinder 5, the force for driving the bucket cylinder 5 to the contracting side swiftly overcomes the frictional resistance of the bucket cylinder 5 and the like, and the cylinder stroke is reduced according to the operation amount on the side of contracting the bucket cylinder 5, so that responsiveness of the bucket cylinder 5 can be enhanced.

While the embodiment of the present invention has been described above, the present invention is not limited to the above embodiment, and various modifications are included therein. For example, while an example of driving the bucket cylinder 5 has been described in the above embodiment, the single rod hydraulic cylinder to be discussed in the present invention is not limited to the bucket cylinder 5. In addition, while a configuration in which the bottom-side proportional valve 44 and the rod-side proportional valve 45 are provided has been adopted in the above embodiment, a configuration in which only the rod-side proportional valve 45 is provided may be adopted. Besides, while the delivery side of the first hydraulic pump 11 has been the bottom side and the delivery side of the second hydraulic pump 12 has been the rod side in the above embodiment, the delivery side of the first hydraulic pump 11 may be the rod side, and the delivery side of the second hydraulic pump 12 may be the bottom side. In addition, control has been performed such as to keep constant the tilting angles of the first to fourth hydraulic pumps 11 to 14, the tilting angles may be regulated in accordance with the operation amount of the bucket lever 70*a* and the open/closed states of the first to fourth control valves 40 to 42.

DESCRIPTION OF REFERENCE CHARACTERS

1: Boom cylinder
2: Boom (Work member)
3: Arm cylinder
4: Arm (Work member)
5: Bucket cylinder
5*a*: Bottom chamber
5*b*: Rod chamber
6: Bucket (Work member)
7: Swing device
8: Track device
9: Engine
10: Power transmission mechanism
11: First hydraulic pump
11*a*: First regulator
12: Second hydraulic pump
12*a*: Second regulator
13: Third hydraulic pump
13*a*: Third regulator
14: Fourth hydraulic pump
14*a*: Fourth regulator
15: Charge pump
20: Charge relief valve
21: Relief valve
22: Relief valve
25: Working fluid tank
26: Charge check valve
27: Charge check valve
28*a*, 28*b*: Charge check valve
30*a*, 30*b*: Relief valve
31*a*, 31*b*: Relief valve
32*a*, 32*b*: Relief valve
33: Flushing valve
40: First control valve
41: Second control valve
42: Third control valve
43: Fourth control valve
44: Bottom-side proportional valve
45: Rod-side proportional valve
50: Controller
51: Lever operation amount calculation section
52: Lever switching period calculation section
53: Actuator pressure balance calculation section
54: Command calculation section
60*a*: First pressure sensor (Bottom pressure sensor)
60*b*: Second pressure sensor (Rod pressure sensor)
70: Operation lever device
70*a*: Bucket lever
100: Hydraulic excavator
101: Lower track structure
102: Upper swing structure
103: Front work device
104: Cab
200 to 205: Pump line
206: Tank line (Bottom-side discharge line)
207: Tank line (Rod-side discharge line)
208: Bottom-side branch line (Bottom-side discharge line)
209: Rod-side branch line (Rod-side discharge line)
210: Bottom-side line (Actuator line)
211: Rod-side line (Actuator line)
212: Charge line
300: Hydraulic drive system

The invention claimed is:

1. A work machine comprising:

a work device including a plurality of work members;

a single rod-type hydraulic cylinder that drives one of the plurality of work members;

a bottom-side line connected to a bottom chamber of the single rod-type hydraulic cylinder;

a rod-side line connected to a rod chamber of the single rod-type hydraulic cylinder;

a bidirectional-type first hydraulic pump of which a delivery port on one side is connected to the bottom-side line through a first control valve and a delivery port on another side is connected to the rod-side line through the first control valve;

a bidirectional-type second hydraulic pump of which a delivery port on one side is connected to the bottom-side line through a second control valve and a delivery port on another side is connected to the rod-side line through the second control valve;

an operation lever device having an operation lever for operating the single rod-type hydraulic cylinder to extend and contract;

a working fluid tank;

a flushing valve that is connected to the bottom-side line and the rod-side line, and that discharges a surplus flow rate of a lower-pressure side one of the bottom-side line and the rod-side line into the working fluid tank when a differential pressure between the bottom-side line and the rod-side line exceeds a predetermined pressure; and a controller that controls opening/closing of the first and second control valves and controls tilting amounts of the first and second hydraulic pumps, wherein the work machine further includes a bottom pressure sensor that detects a pressure in the bottom chamber;

a rod pressure sensor that detects a pressure in the rod chamber;

a rod-side discharge line that connects a portion of the rod-side line between the rod chamber and the first control valve and the working fluid tank; and a rod-side proportional valve provided in the rod-side discharge line, and the controller is configured to, when the operation lever is operated to a side of extending the single rod-type hydraulic cylinder in a state in which the pressure in the rod chamber is higher than the pressure in the bottom chamber, open the rod-side proportional valve such that the differential pressure between the pressure in the rod chamber and the pressure in the bottom chamber is reduced below the predetermined pressure.

2. The work machine according to claim 1, further comprising:

a bottom-side discharge line that connects a portion of the bottom-side line between the bottom chamber and first control valve and the working fluid tank; and a bottom-side proportional valve provided in the bottom-side discharge line, wherein the controller is configured to, when the operation lever is operated to a side of contracting the single rod-type hydraulic cylinder in a state in which the pressure in the bottom chamber is higher than the pressure in the rod chamber, open the bottom-side proportional valve such that the differential pressure between the bottom chamber and the rod chamber is reduced below the predetermined pressure.

3. The work machine according to claim 2, further comprising:

a third control valve provided in a portion of the bottom-side discharge line that connects the bottom-side line and the bottom-side proportional valve;

a single tilting-type third hydraulic pump having a delivery port connected to a portion of the bottom-side discharge line that connects the third control valve and the bottom-side proportional valve, and having a suction port connected to the working fluid tank;

a fourth control valve provided in a portion of the rod-side discharge line that connects the rod-side line and the rod-side proportional valve; and a single tilting-type fourth hydraulic pump having a delivery port connected to a portion of the rod-side discharge line that connects the fourth control valve and the rod-side proportional valve, and having a suction port connected to the working fluid tank.

4. The work machine according to claim 1, wherein the controller is configured to control tilting of the first hydraulic pump such that the working fluid is supplied from the first hydraulic pump to the bottom chamber and control tilting of the second hydraulic pump such that the working fluid is supplied from the second hydraulic pump to the rod chamber when a switching period of the operation lever is equal to or less than a predetermined period, open the first control valve and close the second control valve when the operation lever is operated to the side of extending the single rod-type hydraulic cylinder, and close the first control valve and open the second control valve when the operation lever is operated to a side of contracting the single rod-type hydraulic cylinder.

* * * * *